US006915816B2

(12) United States Patent
Nelson et al.

(10) Patent No.: US 6,915,816 B2
(45) Date of Patent: Jul. 12, 2005

(54) FAUCET SPRAY HEAD HOSE GUIDE AND RETRACTION MECHANISM

(75) Inventors: Alfred C. Nelson, Carmel, IN (US); Jeffrey L. Moore, Frankfort, IN (US); Derek A. Brown, Avon, IN (US)

(73) Assignee: Masco Corporation of Indiana, Indianapolis, IN (US)

( * ) Notice: Subject to any disclaimer, the term of this patent is extended or adjusted under 35 U.S.C. 154(b) by 215 days.

(21) Appl. No.: 10/386,835

(22) Filed: Mar. 12, 2003

(65) Prior Publication Data

US 2004/0177880 A1 Sep. 16, 2004

(51) Int. Cl.[7] ..... B65H 75/34
(52) U.S. Cl. ..... 137/355.23; 137/355.28
(58) Field of Search ..... 137/355.23, 355.28, 137/355.16, 355.21, 355.22, 801

(56) References Cited

U.S. PATENT DOCUMENTS

| | | | | | |
|---|---|---|---|---|---|
| 2,312,528 | A | * | 3/1943 | Davis | 137/355.22 |
| 2,589,544 | A | * | 3/1952 | Ginter | 137/355.17 |
| 3,874,488 | A | | 4/1975 | Wirth | |
| 4,117,858 | A | | 10/1978 | Bucknell et al. | |
| 4,305,553 | A | | 12/1981 | Coquerel | |
| 4,431,031 | A | | 2/1984 | Ettlinger | |
| 4,446,884 | A | | 5/1984 | Rader, Jr. | |
| 4,715,401 | A | | 12/1987 | Staun et al. | |
| 4,715,402 | A | | 12/1987 | Staun et al. | |
| 4,812,070 | A | | 3/1989 | Marty | |
| 4,923,223 | A | | 5/1990 | Seckel | |
| 5,073,991 | A | | 12/1991 | Marty | |
| 5,139,751 | A | * | 8/1992 | Mansfield et al. | 137/355.26 |
| 5,349,987 | A | | 9/1994 | Shieh | |
| 5,450,874 | A | | 9/1995 | Hamula | |
| 5,546,978 | A | | 8/1996 | Parker | |
| 5,560,391 | A | * | 10/1996 | Bantaculo | 137/355.23 |
| 5,560,548 | A | | 10/1996 | Mueller et al. | |
| 5,624,073 | A | | 4/1997 | Mueller et al. | |
| 5,675,847 | A | | 10/1997 | Pierre | |
| 5,685,829 | A | | 11/1997 | Allen | |
| 5,692,536 | A | | 12/1997 | Tokarz | |
| 5,707,011 | A | | 1/1998 | Bosio | |
| 5,758,690 | A | | 6/1998 | Humpert et al. | |
| 5,775,354 | A | | 7/1998 | Upton | |
| 5,884,662 | A | | 3/1999 | Ko | |
| 5,906,319 | A | | 5/1999 | Crowl | |
| 5,926,868 | A | | 7/1999 | Bjerke | |
| 5,934,325 | A | | 8/1999 | Brattoli et al. | |
| 6,006,784 | A | | 12/1999 | Tsutsui et al. | |
| 6,045,062 | A | | 4/2000 | Bosio | |
| 6,082,407 | A | | 7/2000 | Paterson et al. | |
| 6,085,790 | A | | 7/2000 | Humpert et al. | |
| 6,106,027 | A | | 8/2000 | Mulvey et al. | |
| 6,199,579 | B1 | | 3/2001 | Taylor et al. | |
| 6,220,297 | B1 | | 4/2001 | Marty et al. | |
| 6,234,192 | B1 | | 5/2001 | Esche et al. | |
| 6,296,011 | B1 | | 10/2001 | Esche et al. | |
| 6,334,226 | B1 | | 1/2002 | Tokunaga et al. | |
| 6,370,713 | B2 | | 4/2002 | Bosio | |
| 6,381,770 | B1 | | 5/2002 | Raisch | |
| 6,381,774 | B1 | | 5/2002 | Wales | |
| 6,691,933 | B1 | | 2/2004 | Bosio | |
| 2001/0020302 | A1 | | 9/2001 | Bosio | |
| 2003/0188381 | A1 | | 10/2003 | Bosio | |
| 2003/0189107 | A1 | | 10/2003 | Bosio | |
| 2003/0189108 | A1 | | 10/2003 | Bosio | |
| 2004/0144866 | A1 | | 7/2004 | Nelson et al. | |

* cited by examiner

*Primary Examiner*—Kevin Lee
(74) *Attorney, Agent, or Firm*—Woodard, Emhardt, Moriarty, McNett & Henry LLP

(57) ABSTRACT

A faucet assembly includes a faucet hub, a hose, a hose retraction mechanism and a storage bag for storing any slack in the hose. The faucet hub includes at least one hose guide that is used to reduce the amount of wear on the hose. The retraction mechanism allows the hose to extend from the faucet hub. Once in the extended position, the retraction mechanism is configured to lock the hose in the extended position. Upon actuation by the user, the retraction mechanism can retract the hose back inside the faucet hub.

40 Claims, 16 Drawing Sheets

FAUCET SPRAY HEAD HOSE GUIDE AND RETRACTION MECHANISM

BACKGROUND OF THE INVENTION

The present invention generally relates to faucet spray heads, and more specifically, but not exclusively, concerns a faucet hose guide and retraction mechanism.

With today's modern kitchen and bathroom designs, faucets have been redesigned to incorporate faucet spray heads or wands that act both as a spray head as well as a regular faucet. Typically, with such dual faucet heads, the spray head or wand is attached to a flexible spray hose that is threaded from underneath the sink through a faucet body or hub. The spray heads are attached to the spray hose so that the spray head can be extended and moved around a sink by the operator. In one design, a counterweight, which is attached to the spray hose underneath the sink, is used to retract the spray head. However, there are a number of disadvantages with this counterweight design. One disadvantage is that the spray hose is constantly biased to retract the spray head. If the spray head accidentally slips from the user's hand, the spray head will be undesirably retracted, and while retracting, the spray head may accidentally spray water out of the sink and onto the user. Moreover, if the counterweight is not properly positioned along the spray hose, the spray head may not fully retract or the counterweight can act as a stop so as to limit the extent to which the spray head is able to extend.

Other design problems associated with spray head type faucets can inhibit movement of the spray head and/or create excessive wear on components in the faucet. Cabinets underneath sinks are usually cluttered with items, such as cleaning supplies, piping for the faucet, and the like. Consequently, the spray hose can be tangled with these items such that the hose will not be able to extend or retract. After repeated use, the hose can become worn by rubbing against the components in the faucet, thereby creating a potential leakage problem. One design solution has been to house the spray hose in a continuous guide tube or sleeve that reduces the wear on the hose. Although these guide tubes tend to reduce hose wear, they are not practical for faucets with complex shapes. Complicated shaped faucets tend to contain hose cavities with bends and turns that create multiple rub points. To compensate for these multiple rub points, the guide tube would have to be bent in a fashion similar to that of the hose cavity. As should be appreciated, once bent, insertion of the guide tube into the faucet may be extremely difficult, if not impossible.

With the advent of home do-it-yourself hardware stores, homeowners in greater numbers are installing and repairing faucets themselves. One problem homeowners face is where to store the instruction manuals, parts and/or tools that come with the faucet installation kit. Typically, the homeowner either discards these items once the faucet is installed or stores the items in a place where they are not readily accessible. If routine maintenance or emergency repair of the faucet is required, the homeowner may not be able to find these items in order to make the repair.

Thus, there remains a need for improvement in this field.

SUMMARY OF THE INVENTION

One aspect of the present invention concerns a faucet system. The system includes a faucet hub that defines an internal cavity. A first hose guide is positioned inside the internal cavity, and the first hose guide defines a first guide cavity that is centered around a first longitudinal axis. A second hose guide is positioned in the internal cavity, and the second hose guide defines a second guide cavity that is centered around a second longitudinal axis that is out of alignment with the first longitudinal axis. A hose is slidably received in the first guide cavity of the first hose guide and the second guide cavity of the second hose guide to reduce wear on the hose.

Another aspect concerns a faucet system that includes a faucet hub and a hose slidably received in the hub. A faucet spray head is coupled to the hose, and a retraction mechanism engages the hose to retract the hose. The retraction mechanism includes a lock mechanism constructed and arranged to prevent retraction of the hose at variable extended positions from the faucet and to allow retraction of the hose upon further extension of the hose.

A further aspect concerns a faucet system that includes a faucet hub and a hose that is slidably received in the hub. A faucet spray head is coupled to the hose, and a hose guide tube is coupled to the faucet hub. The hose is slidably received in the guide tube, and a bag mounting bracket is secured to the guide tube. A hose storage bag hangs from the bag mounting bracket, and the hose storage bag defines a hose pocket in which slack of the hose is stored.

DESCRIPTION OF SELECTED EMBODIMENTS

Figure 1:
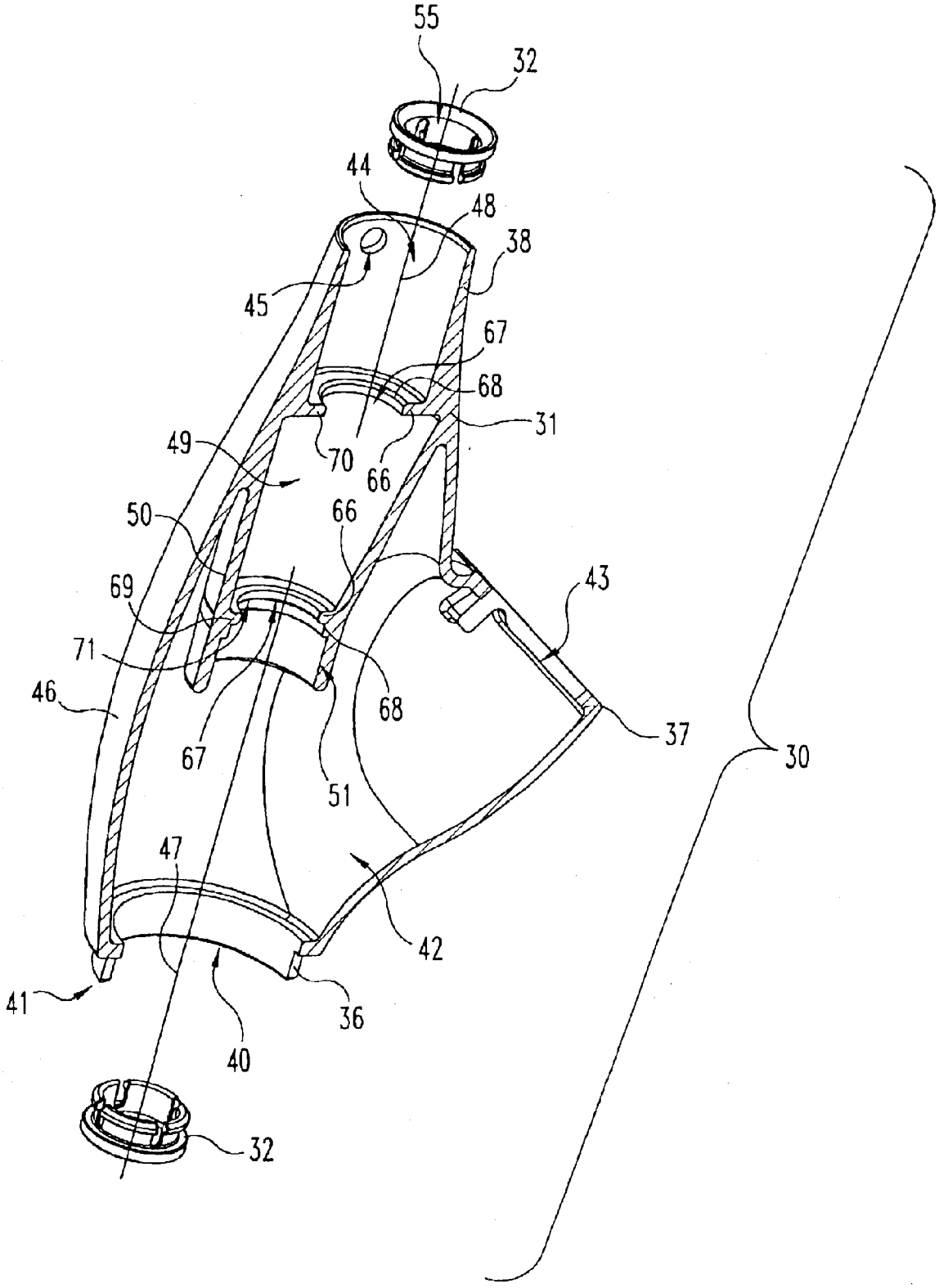
FIG. 1 is an exploded view of a hose guide hub assembly according to one embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
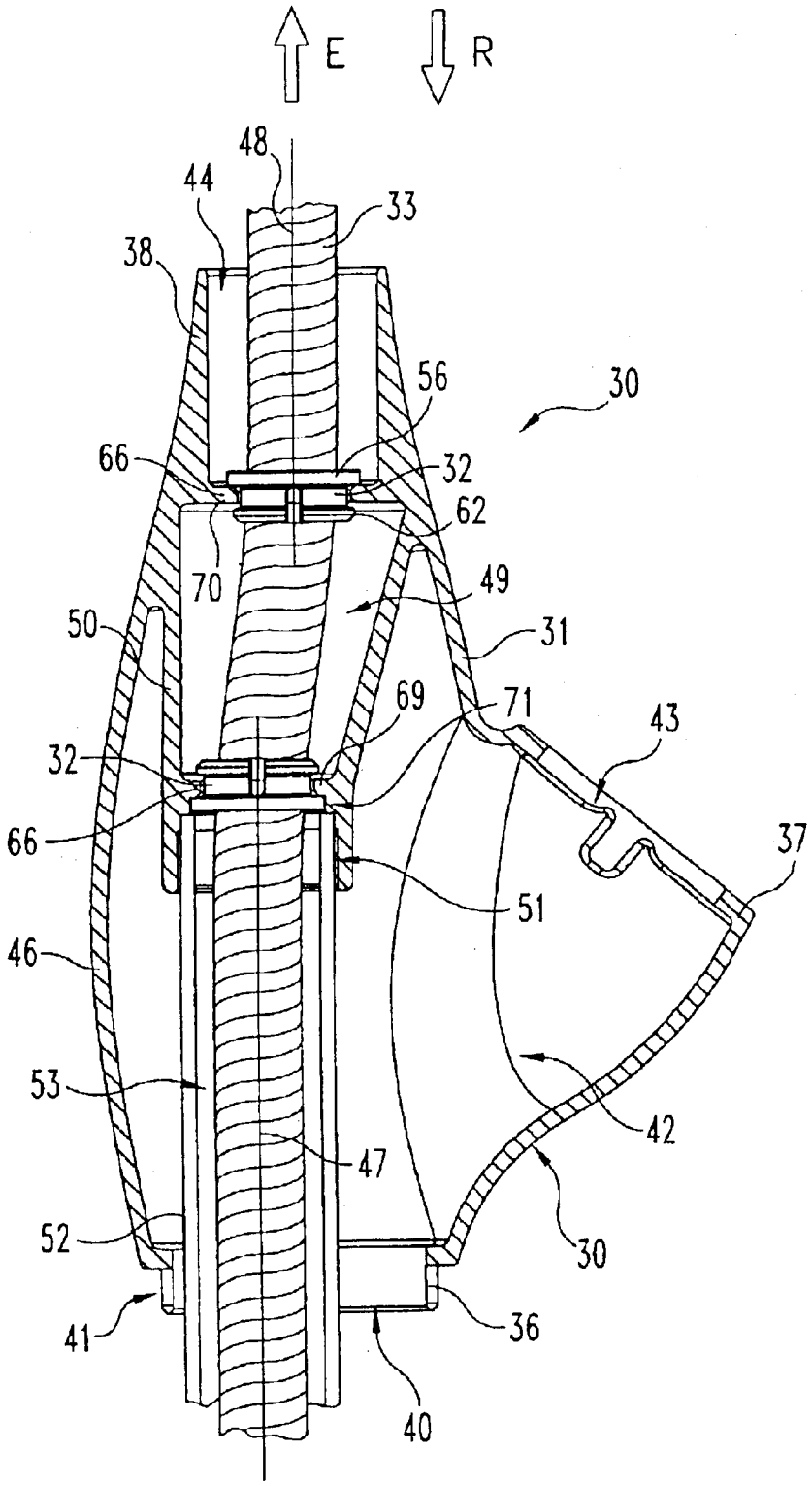
FIG. 2 is a side elevational cross-sectional view, in full section, of the FIG. 1 assembly.
Figure 3:
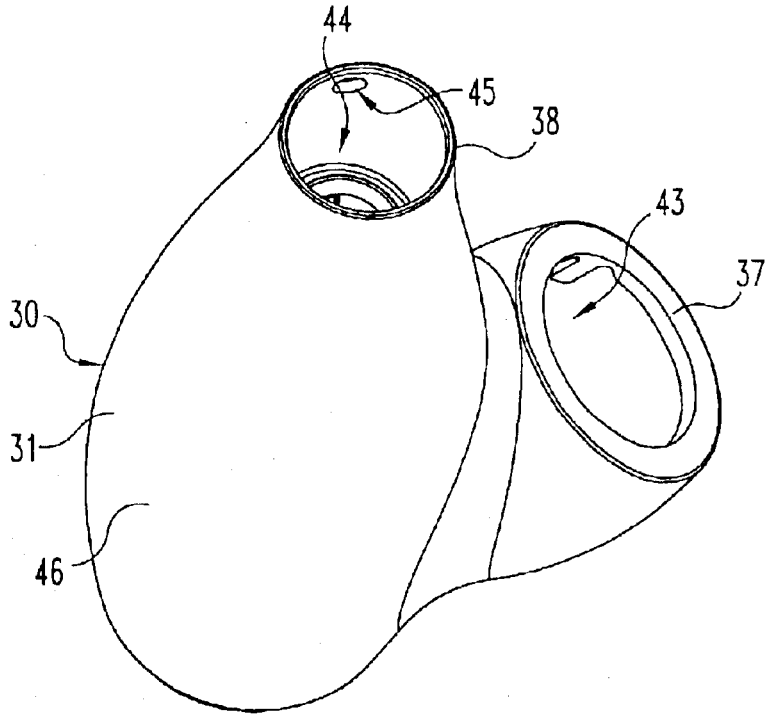
FIG. 3 is a top, perspective view of the FIG. 1 assembly.
Figure 4:
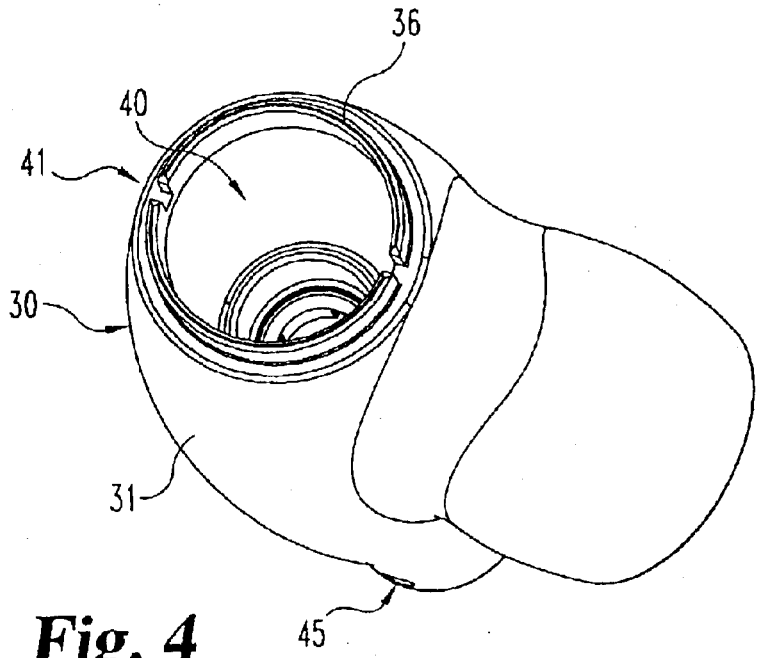
FIG. 4 is a bottom, perspective view of the FIG. 1 assembly

A hose guide hub assembly 30 according to one embodiment of the present invention is illustrated in FIGS. 1–4. Although assembly 30 will be described with reference to a water faucet, it is contemplated that selected features of the present invention can be adapted for use in other fields. For the sake of brevity, features, such as faucet spray heads, valving and the like, that are not necessary to appreciate the present invention will not be described. For examples of such features, please refer to U.S. Pat. No. 6,370,713 to Bosio, issued Apr. 16, 2002, which is hereby incorporated by reference in its entirety. As illustrated in FIGS. 1 and 2, assembly 30 includes a faucet body or hub 31 as well as one or more hose guides 32 that are configured to guide a hose 33. The hub 31 has a mounting end portion 36, a valve control receiving portion 37, and a spout receiving portion 38. The mounting end portion 36 is designed to be mounted on a mounting base or trim member that is attached to the sink. For example, the mounting end portion 36 can be mounted on a trim ring that is used for a center mount style faucet. In another example, the mounting end portion 36 can be attached to a base plate for a deck mount style faucet. At the mounting end portion 36, the hub 31 defines a mounting base opening 40 through which the hose 33 extends. As illustrated in FIG. 4, alignment notches 41, which are defined in the mounting end portion 36, are used for orienting the faucet hub 31 with the trim member. Referring to FIGS. 1 and 2, the hub 31 further defines a hub cavity 42 in which components such as the valving and tubing for the faucet is housed.

As shown in FIG. 1, the valve control receiving portion 37 has a valve control opening 43, which opens into the hub cavity 42. A control for operating the faucet, such as a lever or handle, is received in the valve control opening 43. In the illustrated embodiment, the valve control opening 43 has a generally circular shape, but it is contemplated that opening 43 can be shaped differently. Once assembled, the valving for the faucet is positioned proximal to the valve control opening 43 in the hub cavity 42.

The spout receiving portion 38 defines a spout receptacle or opening 44 that opens into the hub cavity 42. In the illustrated embodiment, the spout receptacle 44 has a circular shape, but in other embodiments, the spout receptacle 44 can be shaped differently. In one embodiment, a spout for the faucet is received inside the spout receptacle 44, and the spray head or wand is coupled to the spout. In another embodiment, the spray head or wand is directly coupled the spout receptacle 44. At the spout receptacle 44, the hub 31 defines a lock-pin opening 45 that is configured in one embodiment to receive a lock-pin for securing the spout or the wand to the hub 31. In different embodiment, the lock pin opening 45 is configured to secure a lock insert, which in turn is used to secure the spray head to the faucet hub 31.

As shown in FIG. 1, outside wall 46 of the faucet hub 31 is curved in the manner illustrated to give the faucet an aesthetically pleasing appearance. To further provide additional aesthetic appeal, the spout receiving portion 38 in the illustrated faucet hub 31 is offset with respect to the mounting end portion 36. In particular, central longitudinal axis 47 of the hose 33 in the mounting base opening 40 extends parallel to, but is positioned offset with respect to, central longitudinal axis 48 of the spout receptacle 44. Since the position of the hose 33 in the mounting base opening 40 and the spout receptacle 44 are offset from one another, the hose 33 inside the hub cavity 42 would tend to rub against the wall 46 of the hub 31. Even in faucet hubs 31 with complex shapes, such as the illustrated offset configuration, the hose guides 32 of the present invention are able to minimize hose wear by guiding the hose 33 through the hub cavity 42, thereby preventing the hose 33 from rubbing against the faucet hub 31. As noted above, if a continuous guide tube was used instead of the discrete hose guide 32 of the present invention, installation of the guide tube into the faucet hub 31 would be extremely impractical, if not impossible. To conform to the offset shape of the hub cavity 42, the continuous guide tube would have to be bent, which in turn would make it difficult to insert the bent guide tube into the hub cavity 42. As will be described in greater detail below, the hose guides 32 of the present invention are relatively easy to install and are able to guide the hose 33 along multiple rub points inside the hub cavity 42.

Inside the hub cavity 42, the hub 31 has a hose guide attachment structure 49 in which the hose guides 32 are secured to the hub 31. As depicted in FIGS. 1–2, the hose guides 32 are detachably mounted within structure 49. This allows the guides 32 to be replaced, once the hose guides 32 become worn. Moreover, this configuration allows the hose guides 32 to be formed from materials different than that of the hub 31. For instance, to promote the sliding action of the hose 33, the hose guides 32 can be formed from plastic, while the hub 31 can be formed from metal. It should be appreciated, however, that the hub 31 and the hose guides 32 can be formed from other materials and/or the same material. The hose guide attachment structure 49 includes a mounting shank engagement portion 50 that extends within the hub cavity 42 towards the mounting end portion 36 of the hub 31. In the illustrated embodiment, the mounting shank engagement portion 50 has a generally cylindrical shape. Nonetheless, it should be appreciated that the mounting shank engagement portion can be shaped differently. The mounting shank engagement portion 50, as illustrated in FIG. 2, defines a mounting shank receptacle 51 in which a mounting shank or hose guide tube 52 is received. In the illustrated embodiment, the mounting shank 52 frictionally engages the shank receptacle 51, but it is contemplated that the mounting shank 52 can be secured to the hub 31 in other manners. As shown, the mounting shank 52 defines a hose cavity 53 in which the hose 33 is slidingly received along axis 47. The mounting shank 52 prevents the hose from being caught or snared on other components within the faucet, such as the water supply tubes or valving. In the illustrated embodiment, the mounting shank 52 has a generally cylindrical shape, but it should be appreciated that the mounting shank 52 can be shaped differently.

Figure 6:
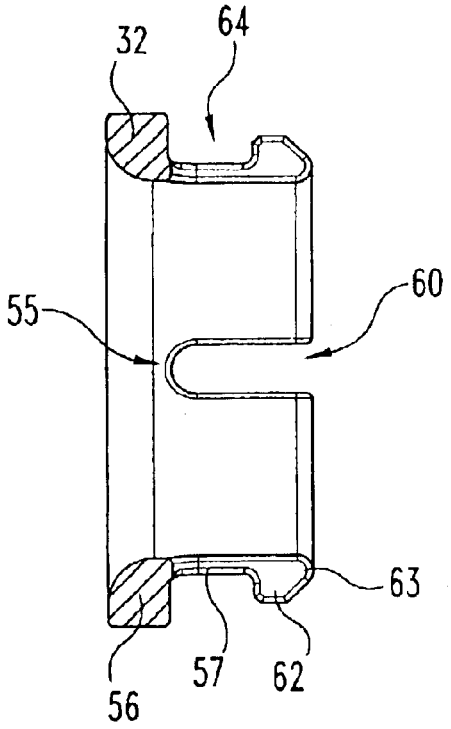
FIG. 6 is a front elevational cross-sectional view, in full section, of the FIG. 5 hose guide as taken along line 6—6 in FIG. 5.
Figure 5:
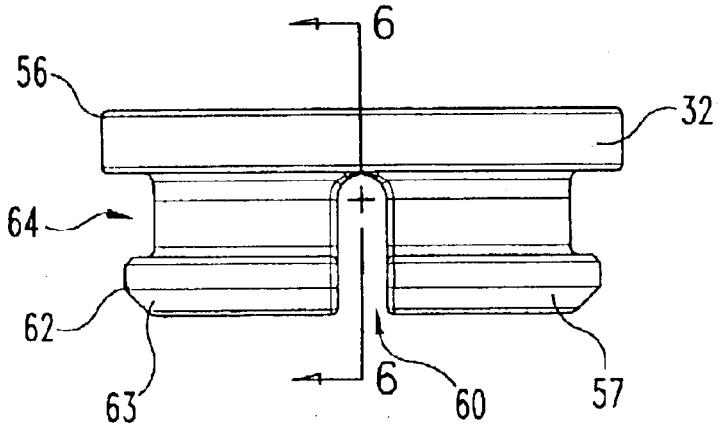
FIG. 5 is a side elevational view of a hose guide used in the FIG. 1 assembly.

The assembly 30 in the illustrated embodiment includes a pair of hose guides 32 that generally correspond to the two rub points in the hub cavity 42 created by offset between mounting end portion 36 and the spout receiving portion 38 in the faucet hub 31. It is contemplated that assembly 30 can include a different number of hose guides 32 than is shown. For example, if the faucet was bent in three locations so as to have three potential rub points, assembly 30 could include three hose guides 32 positioned at the three rub points. Referring to FIGS. 5–6, each hose guide 32 defines a guide cavity 55 through which the hose 33 is able to slide. In the illustrated embodiment, the hose guides 32 have a generally cylindrical shape, but it should be understood that the hose guides 32 can have a different overall shape. Each hose guide 32 has a stop flange 56 and lock arm 57 extending from the stop flange 56. As shown, the stop flange 56 is in the form of an annular ring that radially extends from the hose guide 32 in an outward radial direction. The lock arms 57 are used to secure the hose guides 32 to the hub 31. Relief notches 60 are defined between the lock arms 57 so as to allow the lock arms 57 to deflect in an inward radial direction. Each end of the lock arm 57 has a lock tab 62 that extends in an outward radial direction. To aid in insertion, each lock tab 62 has a beveled or rounded surface 63. A shown, a lock channel 64 is formed between the stop flange 56 and the lock tab 62.

With reference to FIGS. 1–2, structure 49 has guide attachment flanges 66 to which the hose guides 32 are secured. Each flange 66 defines a guide opening 67 in which the hose guides 32 are secured. In order to aid in the insertion of the hose guides 32 into the guide opening 67, the guide attachment flanges 66 further include beveled edges 68 formed around the guide openings 67 that are engageable with the beveled surface 63 on the hose guides 32. In the illustrated embodiment, the flanges 66 include a first flange 69 that is positioned proximal the mounting end portion 36 and a second flange 70 that is located near the spout receiving portion 38. As shown in FIG. 1, the first flange 69 is aligned with and centered around the central longitudinal axis 47 of the mounting shank 52 in the mounting base opening 40. In contrast, the second flange 70 is aligned with and centered around the central longitudinal axis 48 of the spout receptacle 44.

As illustrated in FIG. 2, once one of the hose guides 32 is inserted, the guide attachment flanges 66 are received in the lock channel 64 between the stop flanges 56 and the lock tabs 62. Between the mounting shank receptacle 51 and the first flange 69, the hose guide attachment structure 49 defines a stop flange cavity 71 in which the stop flange 56 of the hose guide 32 is received. As shown, the stop flange 71 is sized to receive the stop flange 56 of the hose guide 32, but the stop flange cavity 71 is smaller than the mounting shank receptacle 51 such that the hose guide attachment structure 49 has a staggered step shape. During installation, the hose guides 32 are snapped into structure 49 such that the lock arms 57 of the hose guides 32 face one another. The hose 33 is then threaded through the mounting shank 52 and the guides 32. As should be appreciated, the hose guides 32 along with the mounting shank 52 provide for smooth sliding movement of the hose 33 in the hub 31.

Figure 7:
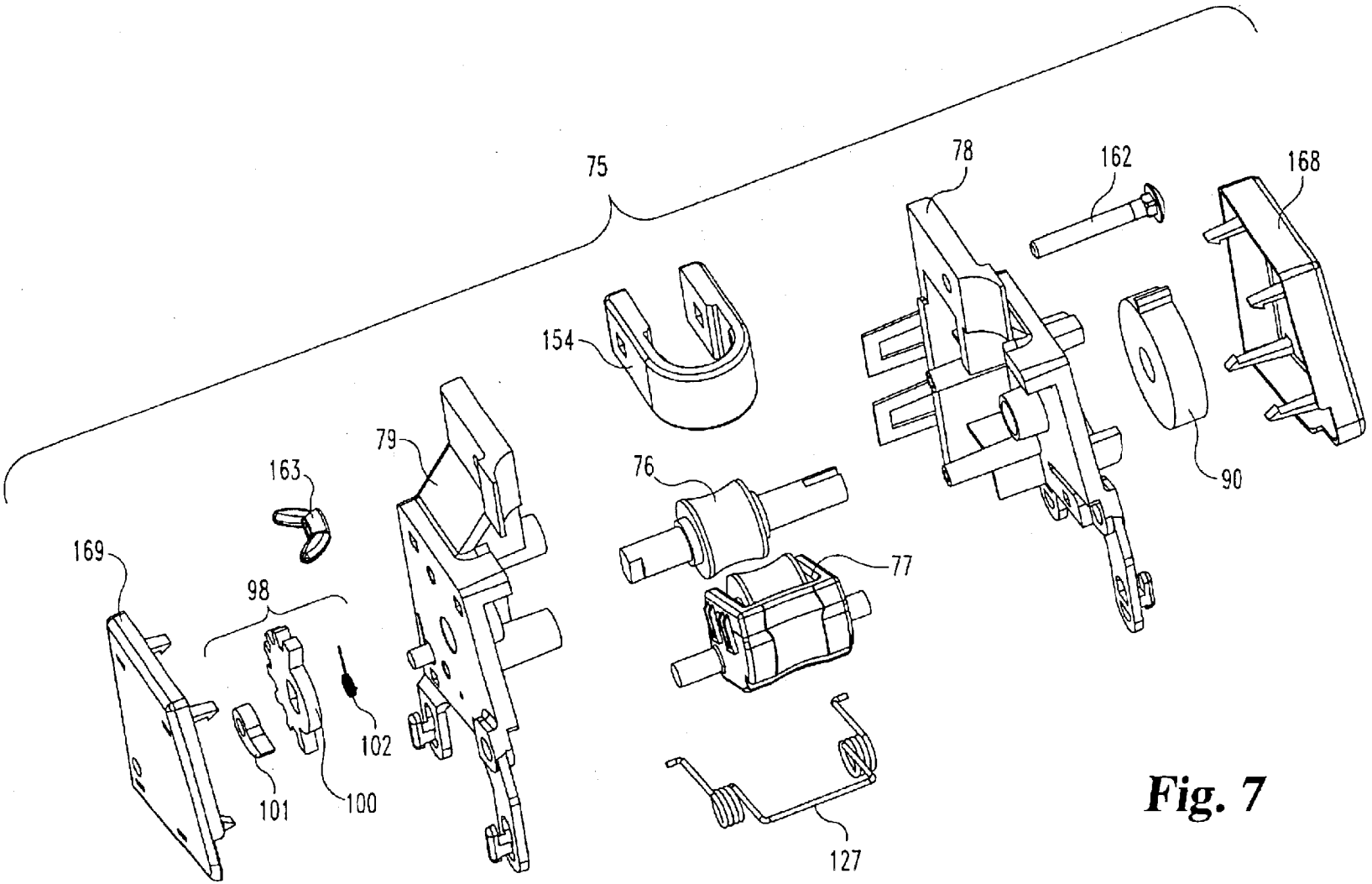
FIG. 7 is an exploded view of a hose retraction mechanism according to one embodiment of the present invention.
Figure 8:
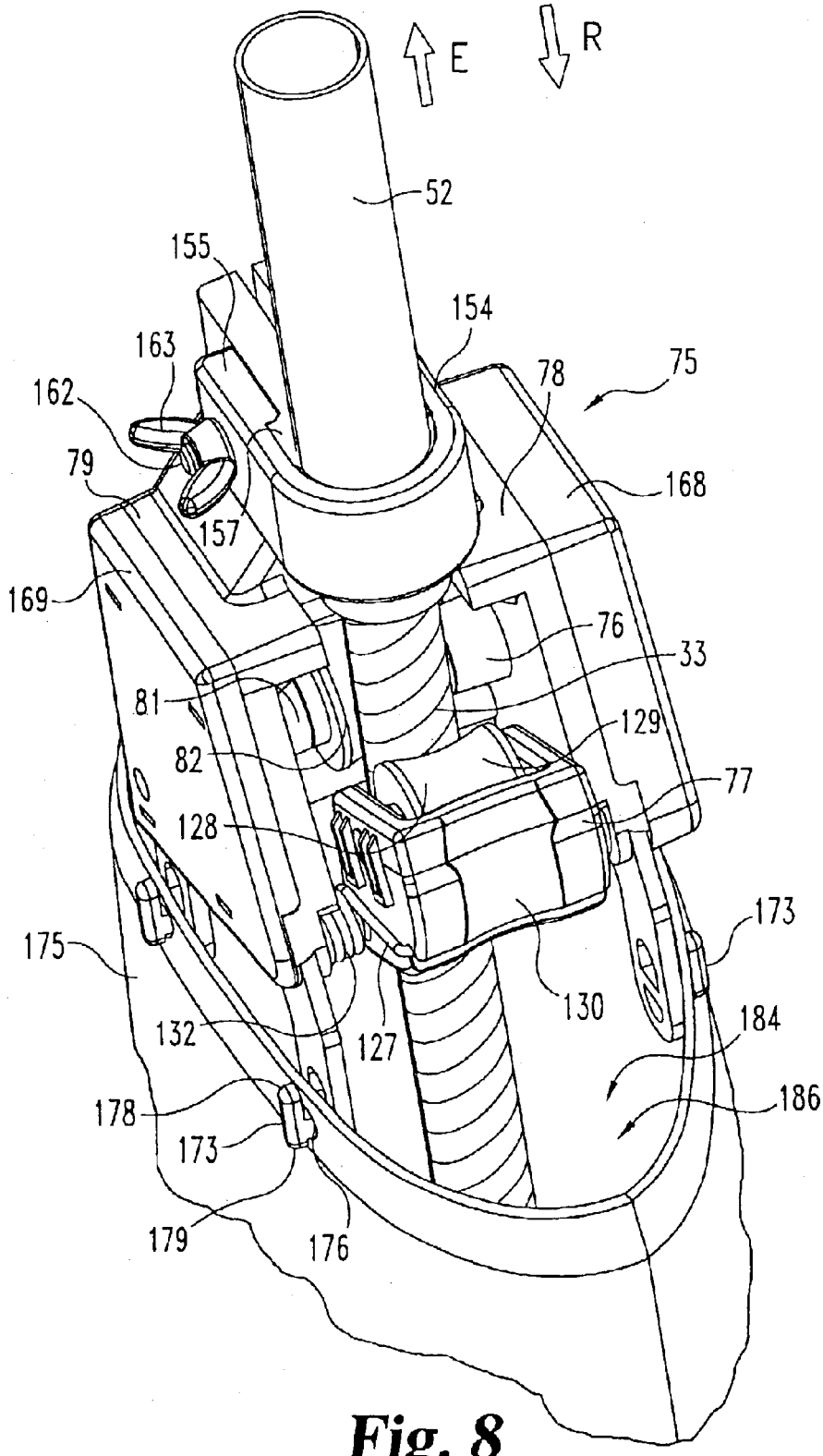
FIG. 8 is a perspective view of the FIG. 7 retraction mechanism.
Figure 9:
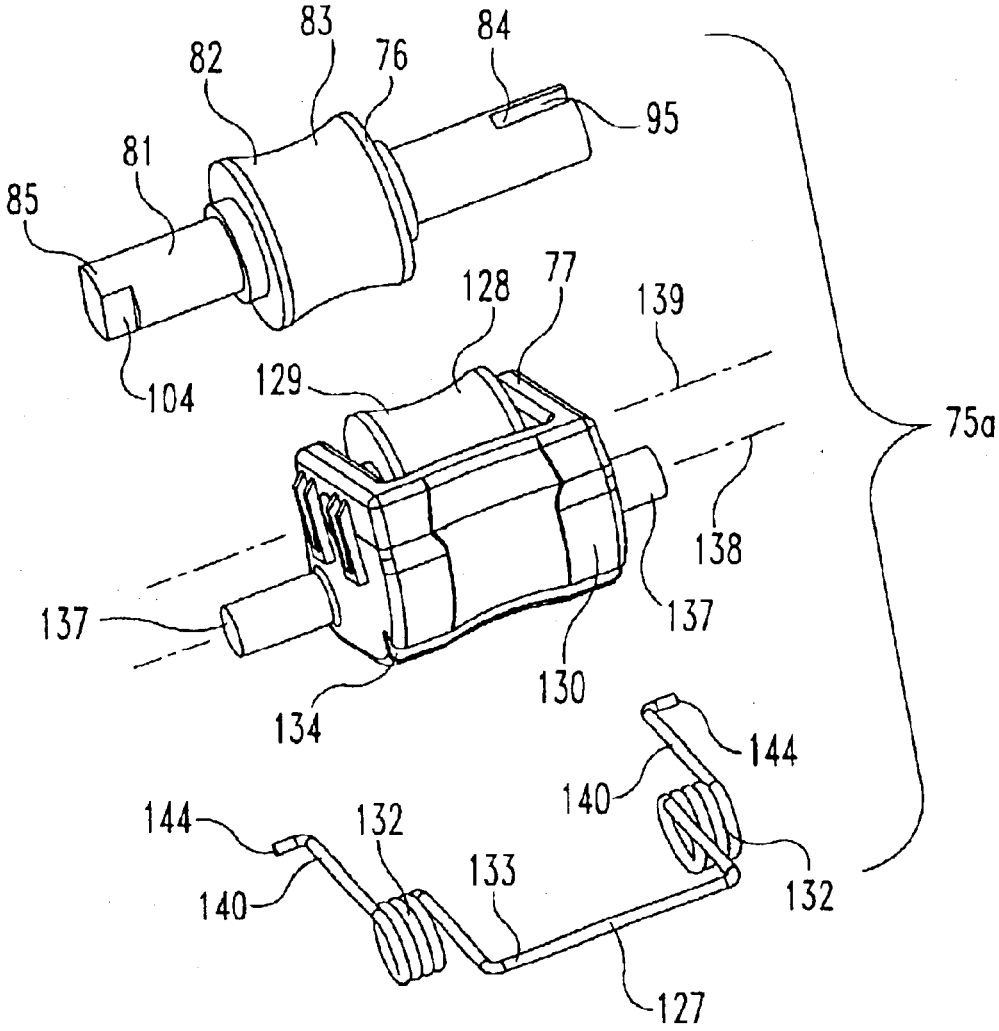
FIG. 9 is an exploded view of a roller subassembly used in the FIG. 7 retraction mechanism.

A hose retraction mechanism 75, according to one embodiment of the present invention, is illustrated in FIGS. 7–14. So that the components of the retraction mechanism 75 can be readily viewed, the exploded view of the retraction mechanism 75 illustrated in FIG. 7 has been broken out into three subviews in FIGS. 9–11. Specifically, these subviews include an exploded view of a roller subassembly 75*a* in FIG. 9, an exploded view of a drive subassembly 75*b* in FIG. 10 and an exploded view of a locking subassembly 75*c* in FIG. 11. As shown in FIG. 7, the retraction mechanism 75 includes a drive roller 76 and an idler roller 77 that are rotatably mounted between first 78 and second 79 support members. In FIG. 9, the drive roller 76 includes a drive shaft 81 and a drive roller wheel 82. In one embodiment, the roller wheel 82 is formed from a soft plastic, and in one particular form, the roller wheel 82 is formed from a soft eurothane material. It is nevertheless contemplated that the roller wheel 82 can be formed from other types of material. The roller wheel 82 of the drive roller 76 has a contact surface 83 that engages the hose 33. In the illustrated embodiment, the roller wheel 82 has a generally cylindrical shape with the contact surface 83 having a concave shape so as to generally coincide with the shape of the hose 33. In a further embodiment, the contact surface 83 is roughened in order to improve traction between the roller wheel 82 and the hose 33. The contact surface 83 in one particular form has ridges which coincide with ridges formed on the hose 33 so as to form a gear and chain-like engagement that minimizes slippage between the hose 33 and the drive roller 76. As shown, the drive shaft 81 of the drive roller 76 has a first end 84 and an opposite second end 85.

Figure 10:
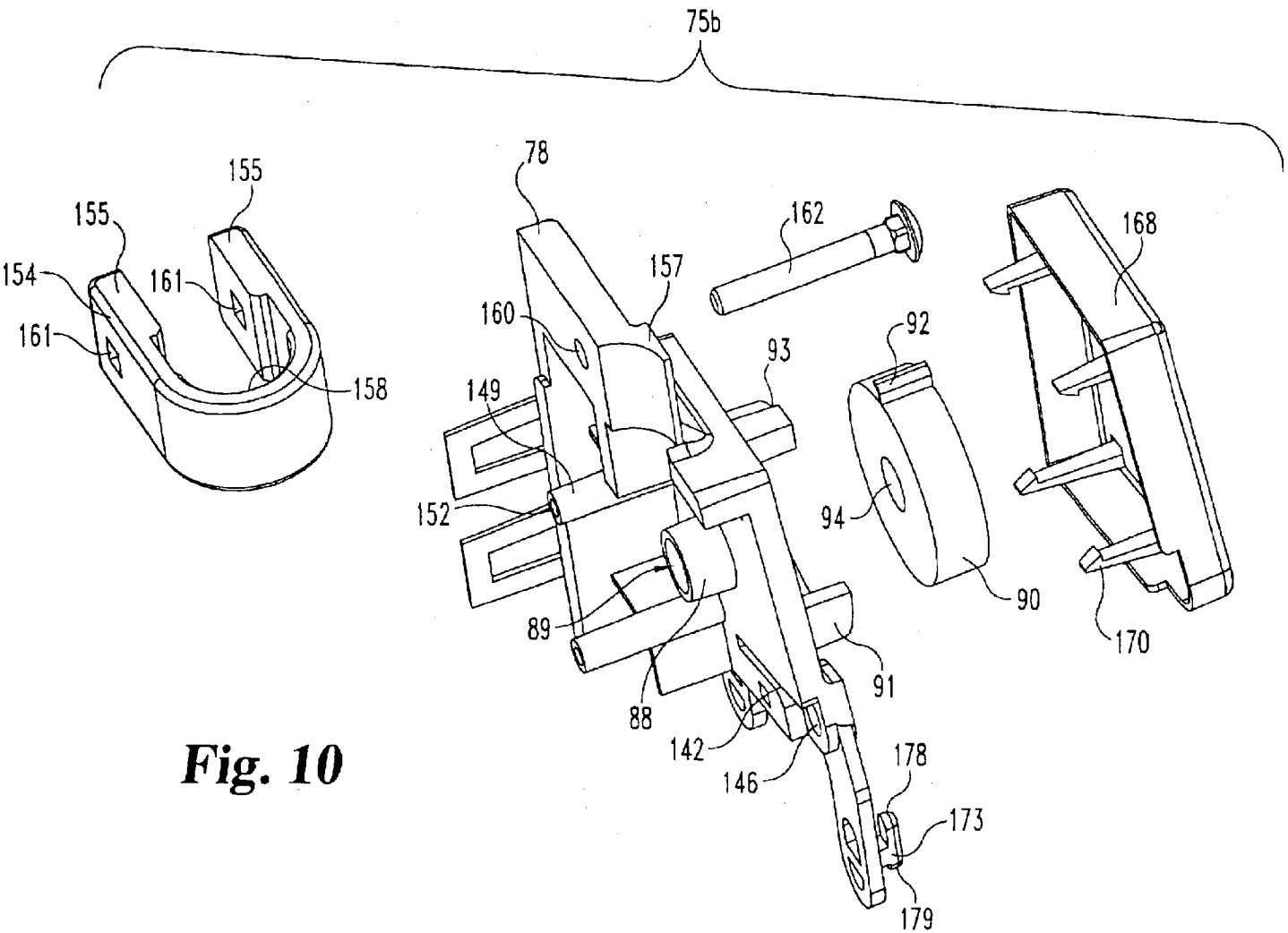
FIG. 10 is an exploded view of a drive subassembly used in the FIG. 7 retraction mechanism.

As depicted in FIGS. 7 and 10, the first support member 78 has a drive shaft centering member 88 extending towards the roller wheel 82 of the drive roller 76. Once assembled, the first end 84 of the drive shaft 81 extends through the drive shaft opening 89 in the centering member 88 so as to engage drive spring 90. The drive spring 90 is used to rotate the drive roller 76 in order to retract the hose 33. In the illustrated embodiment, drive spring 90 is in the form of a coil spring. It should be appreciated, however, that the drive spring 90 can include other types of mechanisms and structures that perform a similar function. Drive spring 90 is received inside a spring retention flange 91. The drive spring 90 has an outer end 92 that is secured in a spring slot 93 defined in the spring retention flange 91. Inner end 94 of the drive spring 90 is secured inside a drive spring notch 95 that is defined in the first end 84 of the drive shaft 81. The retraction mechanism 75 according to the illustrated embodiment can retract the hose without needing an outside power source. The drive spring 90 is used to store energy as the hose 33 is extended, and is used to drive the drive roller 76 in order to retract the hose 33.

Figure 11:
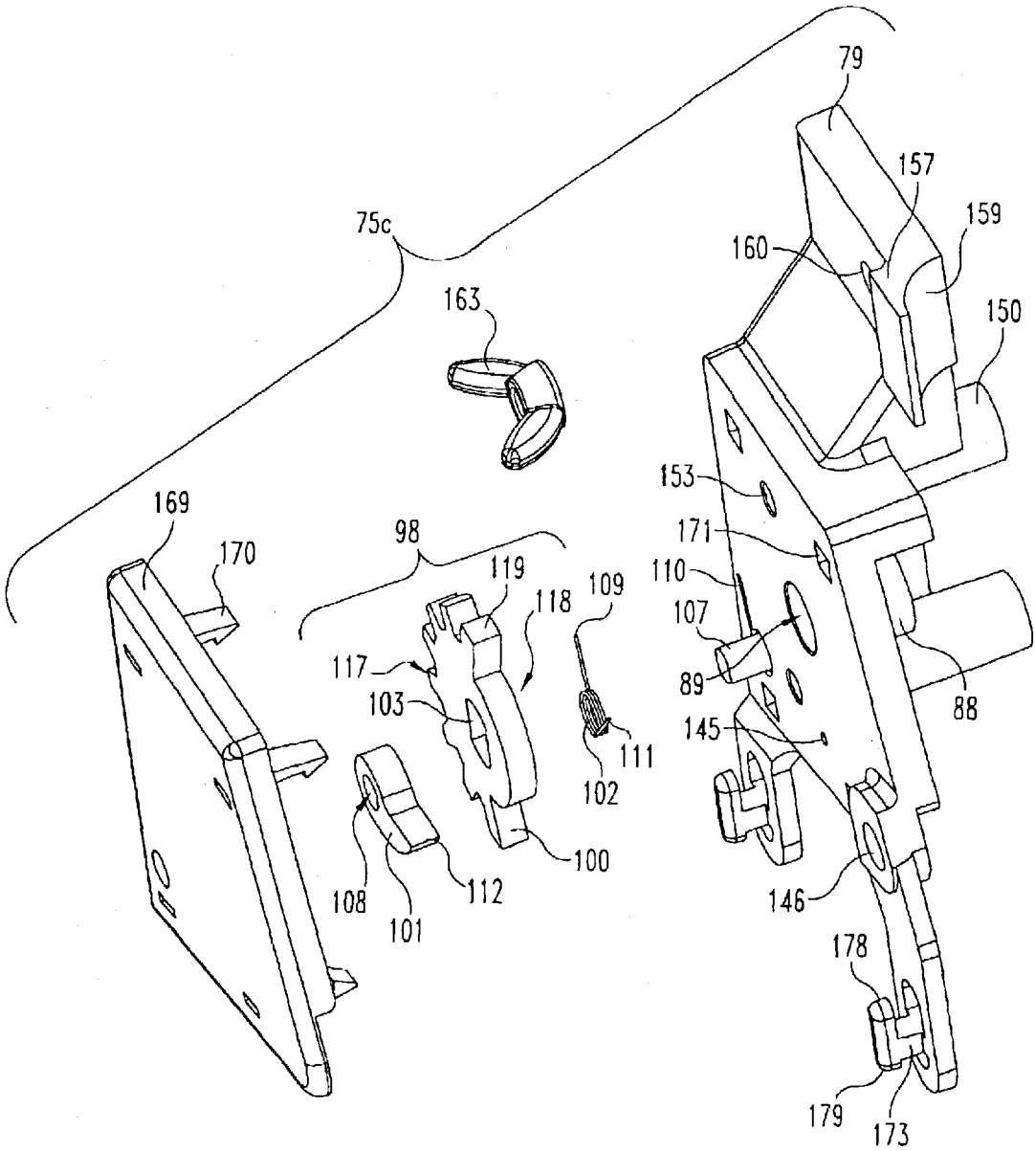
FIG. 11 is an exploded view of a locking subassembly used in the FIG. 7 retraction mechanism.

Referring to FIGS. 7, 9 and 11, the second end 85 of the drive shaft 81 engages a locking mechanism 98 that is used to maintain the hose in the extended position. In FIG. 11, the locking mechanism 98 includes a ratchet gear 100, a pawl 101, and a pawl spring 102 for biasing the pawl 101 against the ratchet gear 100. The ratchet gear 100 defines a shaft engagement opening 103 that engages a ratchet engagement portion 104 of the drive shaft 81. Both the ratchet engagement opening 103 and the ratchet engagement portion 104 in the illustrated embodiment have a semi-rectangular shape so that the ratchet gear 100 and the drive shaft 81 rotate in unison. The second support member 79 has a pawl pin 107 on which the pawl 101 is pivotally mounted. As illustrated, a pawl pin opening 108 is formed in the pawl 101, and the pawl pin 107 is received in the pawl pin opening 108. The pawl spring 102 is wrapped around the pawl pin 107 between the second support member 79 and the pawl 101. A first end 109 of the pawl spring 102 is attached inside a pawl spring engagement slot 110 defined in the second support member 79. A second end 111 of the pawl spring 102 engages the pawl 101 in order to bias the pawl 101 against the ratchet gear 100. As illustrated, the pawl 101 has a ratchet engagement finger 112 that engages the ratchet gear 100.

Figure 12:
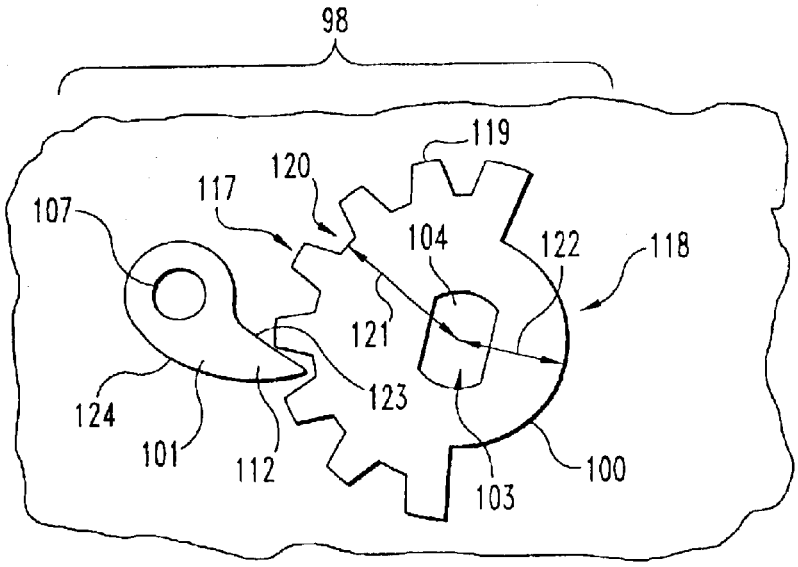
FIG. 12 is a front elevational view of a locking mechanism for the FIG. 7 retraction mechanism during extension of a spray hose.
Figure 13:
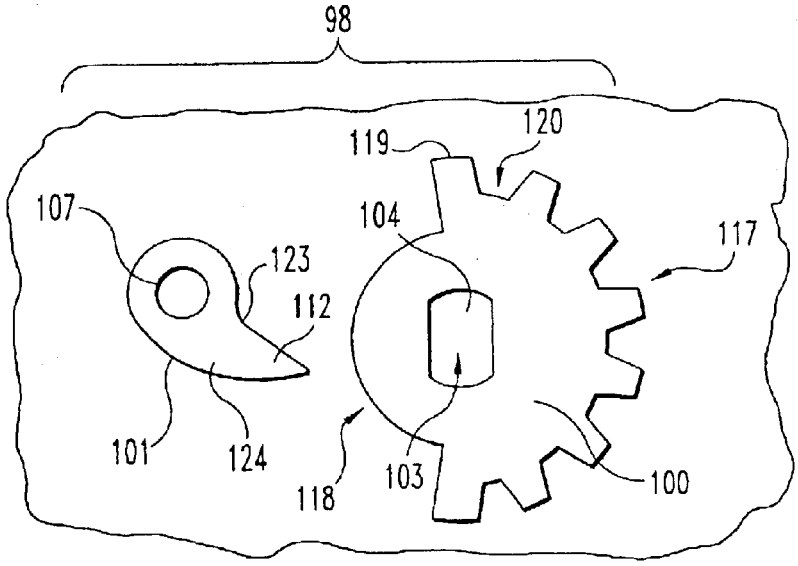
FIG. 13 is a front elevational view of the FIG. 12 locking mechanism configured to allow retraction of the spray hose.
Figure 14:
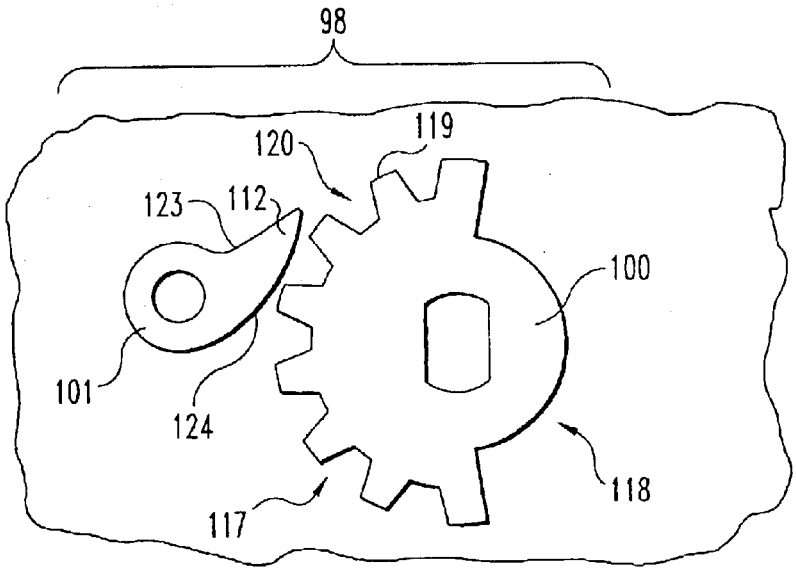
FIG. 14 is a front elevational view of the FIG. 12 locking mechanism during retraction of the spray hose.

Referring to FIGS. 12–14, the ratchet gear 100 has a geared portion 117 and an ungeared or disengagement portion 118. FIG. 12 shows the pawl 101 engaging the ratchet gear 100, for example, during extension of the hose 33 or when the hose 33 is locked in an extended positioned. On the other hand, FIG. 13 illustrates the position of the pawl 101 and the ratchet gear 100 as the locking mechanism 98 becomes unlocked, and FIG. 14 depicts the locking mechanism 98 during retraction of the hose 33. With reference to FIG. 12, the geared portion 117 has gear teeth 119 with gear notches 120 defined therebetween. The depth of the gear notches 120 is sized to prevent the ratchet engagement finger 112 from disengaging from the gear teeth. In contrast, the depth of the disengagement portion 118 is sized to allow the pawl 101 to disengage from the gear teeth 119, as shown in FIG. 13. To allow for disengagement of the pawl 101 during hose retraction, radial distance 120 from the center of the shaft engagement opening 103 to the gear notches 120 is greater than radial distance 122 to the disengagement portion 118. In the illustrated embodiment, the pawl 101 has a shape similar to that of a comma (“,”). The ratchet engagement finger 112 has a lock surface 123 that has a curved concave shape and a disengagement surface 124 that has a curved convex shape.

The retraction mechanism 75 functions in a manner similar to that of a roller type window shade. During extension of the hose 33, the pawl spring 102 biases the ratchet engagement finger 112 against the gear teeth 119, as is shown in FIG. 12. Once the spray head attached to the hose 33 has been extended to the desired length from the faucet, the locking mechanism 98 prevents the drive spring 90 from retracting the hose 33 by having the engagement finger 112 engage one the gear notches 120. As noted above, the gear notches 120 are relatively shallow so as to prevent the pawl 101 from disengaging the gear teeth 119. As soon as the hose 33 is locked in the desired extended position, the person holding the spray head does not feel any pull on the spray head. The spray head will not retract even when the user releases their grip and/or drops the spray head. To retract the spray head, the user simply pulls to extend the hose 33 a slight amount until disengagement portion 118 of the ratchet gear 100 is rotated proximal the engagement finger 112, as is shown in FIG. 13. Once the ratchet gear 100 is positioned such that the ratchet finger 112 is positioned in the disengagement portion 118, the ratchet gear 100 can be rotated in an opposite direction in which the disengagement surface 124 of the pawl 101 rides along the gear teeth 119 of the ratchet gear 100, thereby allowing the ratchet 100 to rotate in an opposite direction.

As illustrated in FIGS. 7–9, a pretensioner spring 127 biases the idler roller 77 against the hose 33, thereby compressing the hose 33 between the drive roller 76 and the idler roller 77. The idler roller 77 ensures that the hose is firmly pressed against the roller wheel 82 of the drive roller 76 such that little slippage occurs between the hose 33 and the drive roller 76. Referring to FIG. 9, the idler roller 77 includes an idler roller wheel 128 with a hose contacting surface 129 that has a concave shape. The idler roller wheel 128 can be made of material of like those described above with reference to the drive roller wheel 82 of the drive member 76. The idler roller wheel 128 is rotatably mounted in a housing 130. In the illustrated embodiment, the pretensioner spring 127 is generally U-shaped and has a pair of coil portions 132 that are connected together by a housing engagement portion 133. The housing 130 defines a pretensioner slot 134 in which the housing engagement portion 133 of the pretensioner spring 127 is received. As illustrated, slot 134 is oriented in a generally parallel relationship with respect to the drive shaft 81 of the drive roller 76. The housing 130 further includes pivot pins 137, which extend along a first longitudinal axis 138 of the idler roller 77. Roller wheel 128 rotates about a second longitudinal axis 139 that is parallel to and yet offset from the first longitudinal axis 138 of the pivot pins 137. This arrangement allows the idler roller wheel 128 to move towards or away from the drive roller 76. The coil portions 132 of the pretensioner spring 127 are received around the pivot pins 137. As depicted in FIGS. 9–11, the pretensioner spring 127 further has a pair of support engagement arms 140 that are received in pretensioner slots 142 defined in the first 78 and second 79 support members. In the illustrated embodiment, the engagement arms 140 have L-shaped engagement tips 144 that are received in tip openings 145 defined in the support member 78 and 79 (FIG. 11). The pivot pins 137 of the idler roller 77 are pivotally mounted in pivot pin openings 146 defined in support member 78 and 79. With such a construction, the pretensioner spring 127 biases the idler roller 77 about the pivot pins 137 such that the roller wheel 128 is rotated towards the drive shaft 76, thereby pressing the hose 33 therebetween. As noted above, the idler roller 77 ensures that the hose 33 is constantly pressed against the drive roller 76 so as to reduce any slippage. The idler roller 77 can also be pivoted away from the drive roller 76 so that the hose 33 can be repositioned and the tension of the drive spring 90 can be adjusted.

The first 78 and second 79 support members can be attached together in a number of manners. For example, in the embodiment illustrated in FIGS. 10 and 11, the first support member 78 has a pair of male connector arms 149, and the male connector arms 149 are received in female connector arms 150 that extend from the second support member 79. The male connector arm 149 has a screw hole 150, and the second support member 79 has a screw opening in which a screw can be slidably received and threadedly secure inside the screw hole 152. It should be appreciated, however, that the support members 78 and 79 can be connected together in other manners.

In FIG. 8, the retraction mechanism 75 further includes a mounting shank clamp 154 that secures the mounting shank 52 to the retraction mechanism 75. As described above with reference to FIG. 2, the mounting shank 52 extends from the retraction mechanism 75 into the hub 31 so as to provide smooth guidance of the hose 33 during extension and retraction. Referring to FIGS. 7 and 10, the clamp 154 is U-shaped and includes support engagement tabs 155 that engage clamp engagement tabs 157 formed on support members 78 and 79. Both the clamp 154 and the clamp engagement tabs 157 have shank engagement surfaces 158 and 159, respectively, that have generally curved shapes in order to coincide with the shape of the mounting shank 52. Support members 78 and 79 have screw openings 160, and the clamp 154 has a pair of screw openings 161 through which a clamp screw 162 is received. The clamp 154 is secured to the support members 78 and 79 through a nut 163, which in the illustrated embodiment is a wing nut. It should be appreciated that the clamp 154 can be secured in other manners, nonetheless. The drive spring 90 and the locking mechanism 98 are respectively housed by first 168 and second 169 support covers, as is shown in FIG. 8. With reference to FIGS. 10 and 11, the covers 168 and 169 have lock tabs 170 the are received and secured in lock tab openings 171 defined in the support members 78 and 79. Support covers 168 and 169 protect the retraction mechanism 75 from the outside environment.

Figure 15:
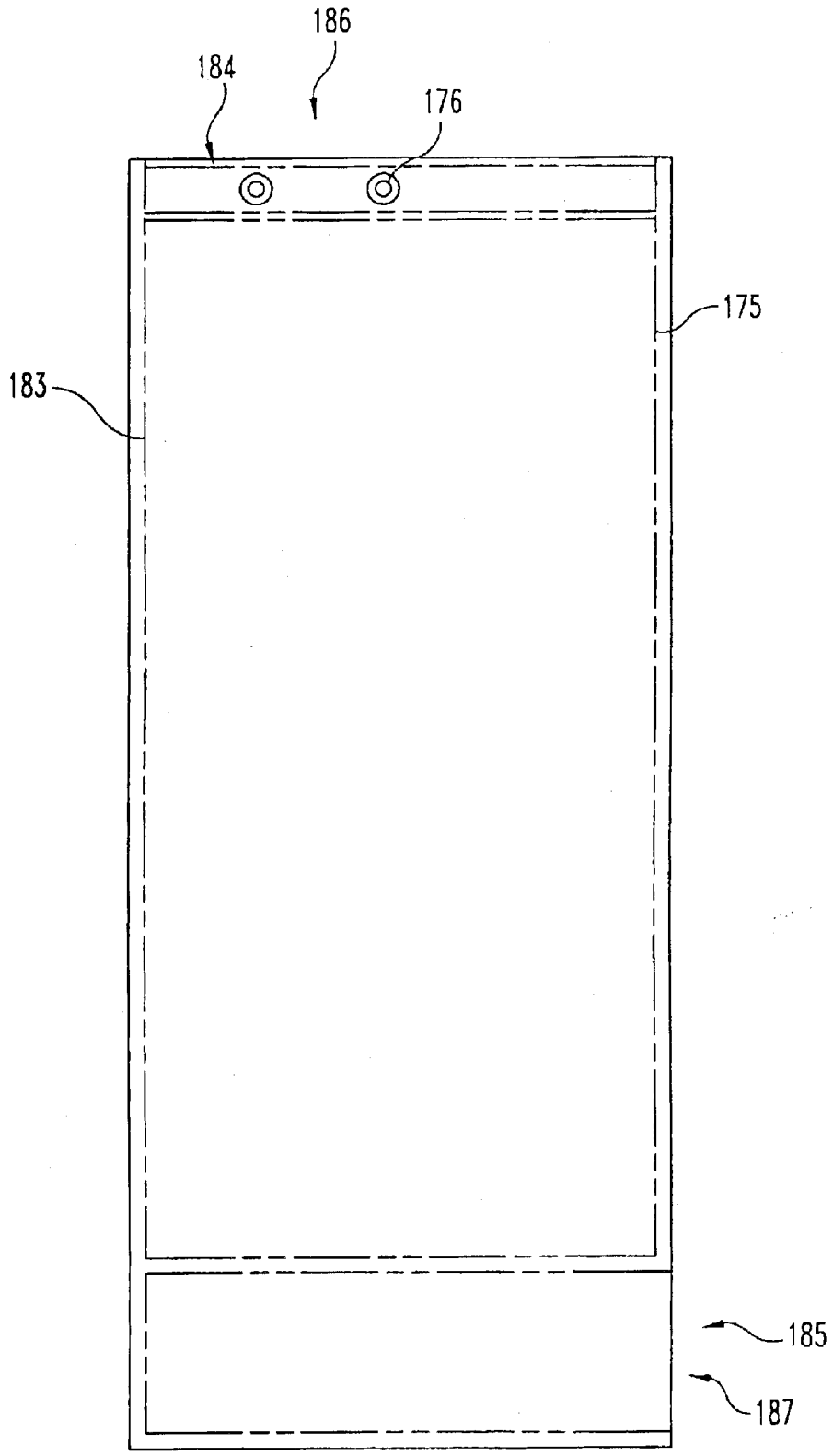
FIG. 15 is a front elevational view of a spray hose storage bag according to one embodiment of the present invention.

As illustrated in FIG. 8, the retraction mechanism 75 further includes bag hooks 173 that are configured to hold a hose storage bag 175 according to one embodiment of the present invention. In the illustrated embodiment, the retraction mechanism 75 includes four (4) hooks 173, but it is contemplated that the retraction mechanism 75 can include more or less hooks 173 than is shown. The hose storage bag 175 prevents the hose 33 from being tangled with objects underneath the sink during extension and retraction. Each hook 173 has a pair of opposing first 178 and second 179 hook members that together prevent the bag 175 from slipping off the hooks 173. The bag 175 has hook openings 176 from which the bag 175 is hung from the hooks 173. As shown, the first hook member 178 is longer than the second hook member 179, and both hook members 178 and 179 engage around the hook openings 176 to ensure that the bag 175 is firmly secured. Referring to FIG. 15, the bag 175 has sealed seams 183 that define a hose storage pocket 184 and an instructions/tools storage pocket 185. The hose storage pocket 184 is configured to store the hose 33 and has a hose pocket opening 186 formed proximal the hose retraction mechanism 75. The instruction storage pocket 185 is adapted to store instructions, faucet parts and/or tools that can concern the installation, maintenance and/or repair of the faucet. For example, pocket 185 can be used to store the instruction manual and socket that are used to install the faucet. By having the instruction manual, parts and/or tools stored in pocket 185, these items are readily available for any required maintenance or repairs. As shown in FIG. 15, pocket 185 has an instruction opening 187 that opens at a position that is transverse to, and specifically perpendicular to, opening 186 of the hose storage pocket 184 so that the user can readily gain access to the instructions storage pocket 185.

Figure 16:
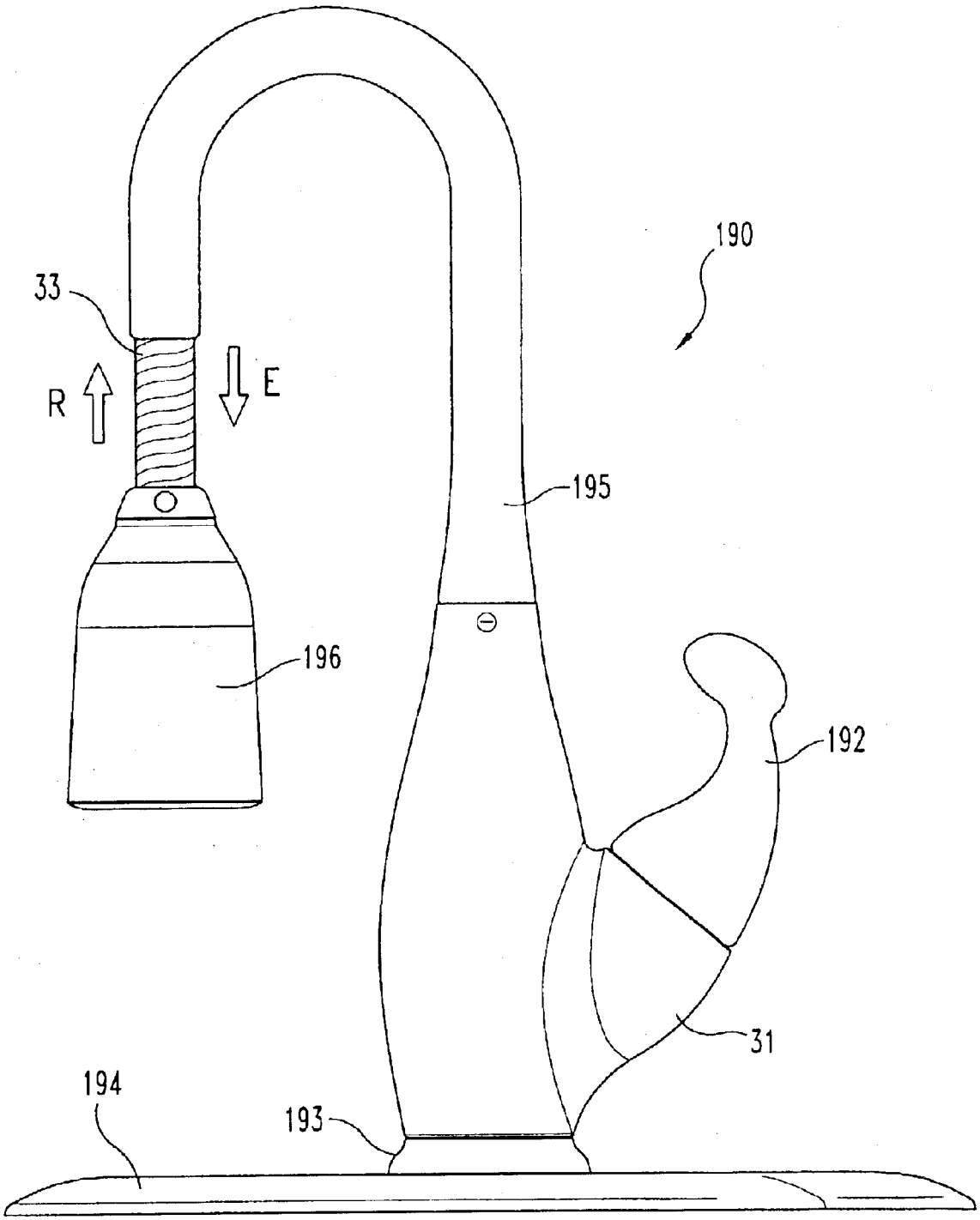
FIG. 16 is a side elevational view of a faucet system incorporating the FIG. 7 retraction mechanism.

FIG. 16 illustrates a faucet system 190 that utilizes the retraction mechanism 75 according to the present invention. As shown, the faucet system 190 includes the faucet hub 31, a faucet control lever 192 that controls the flow of water, and a trim member or base 193 that mounts the hub to a deck 194. A spout 195 extends from the hub 31, and the hose 33 is slidably received inside the spout 195. The hose 33 is connected to a dual function spray head or wand 196 that is operable to supply the water as an aerated stream, as a spray or as both. When the faucet system 190 is used, the user can pull the spray head 196 from the spout 195. As the spray head 196 is extended from the spout 195, the hose 33 travels in an extension direction E, as is shown in FIGS. 2, 8 and 16. The hose 33 slides within the mounting shank 52 and the hose guides 32. As previously mentioned, the hose guides 32 as well as the mounting shank 52 allow the hose 33 to smoothly slide within the faucet, and further reduces wear on the hose 33. As the hose 33 slides in extension direction E, the drive roller 76 rotates, and the idler roller 77 presses the hose 33 against the drive roller 76 in order to prevent slippage of the hose 33 on the drive roller 76. When the drive roller 76 is rotated during extension of the hose 33, the drive spring 90 is wound, and the ratchet gear 100 rotates in a counterclockwise fashion as illustrated in FIG. 12. It should be noted that in other embodiments the ratchet gear 100 can rotate in different directions during extension and retraction of the spray head 196. If the user stops pulling on the spray head 196, the pawl 101 of the locking mechanism 98 engages the geared teeth 119 on the ratchet gear 100, thereby preventing the hose 33 from retracting due to the force imparted by the now wound drive spring 90. Once the hose 33 is locked in an extended position, the user does not have to keep pulling on the hose 33 in order to maintain the spray head 196 in the desired extended position. As should be appreciated, the retraction mechanism 75 according to the present invention allows the spray head 196 to be extended and locked into position at variable distances.

To retract the spray head 196, the user slightly pulls on the hose 33 in the extension direction E until the user feels the locking mechanism 98 disengage, as is shown in FIG. 13. By slightly pulling the hose 33 in the extension direction E, the ratchet gear 100 is rotated such that the disengagement portion 118 faces the pawl 101. Upon the disengagement portion 118 facing the pawl 101, the pawl spring 102 biases the pawl 101 to extend towards the ratchet gear 100. Once the locking mechanism 98 is disengaged, the user can simply release the spray head 196, and the potential energy stored in the wound drive spring 90 is then used to retract the hose 33, through the drive roller 76, in the retraction direction R. During retraction, as is shown in FIG. 14, the curved disengagement surface 124 of the pawl 101 rides along the geared teeth 119 such that the hose 33 cannot be locked in an extended position. Once the spray head 196 is fully retracted, the user can pull on the hose 33 in the extension direction E so that the locking mechanism 98 re-engages and supports the hose 33 in the extended position. Alternatively or additionally, during retraction, the user can halt the retraction of the hose 33 and slightly pull on the hose 33 in the extension direction to re-engage the locking mechanism 98 such that the pawl 101 engages the geared teeth 119. If the drive spring 90, for some reason, is not wound properly, the idler roller 77 can be pivoted away from the hose 33 so that the hose 33 disengages from the drive shaft 76, thereby allowing the user to rotate the drive roller 76 such that the proper tension is applied to the drive spring 90.

Figure 17:
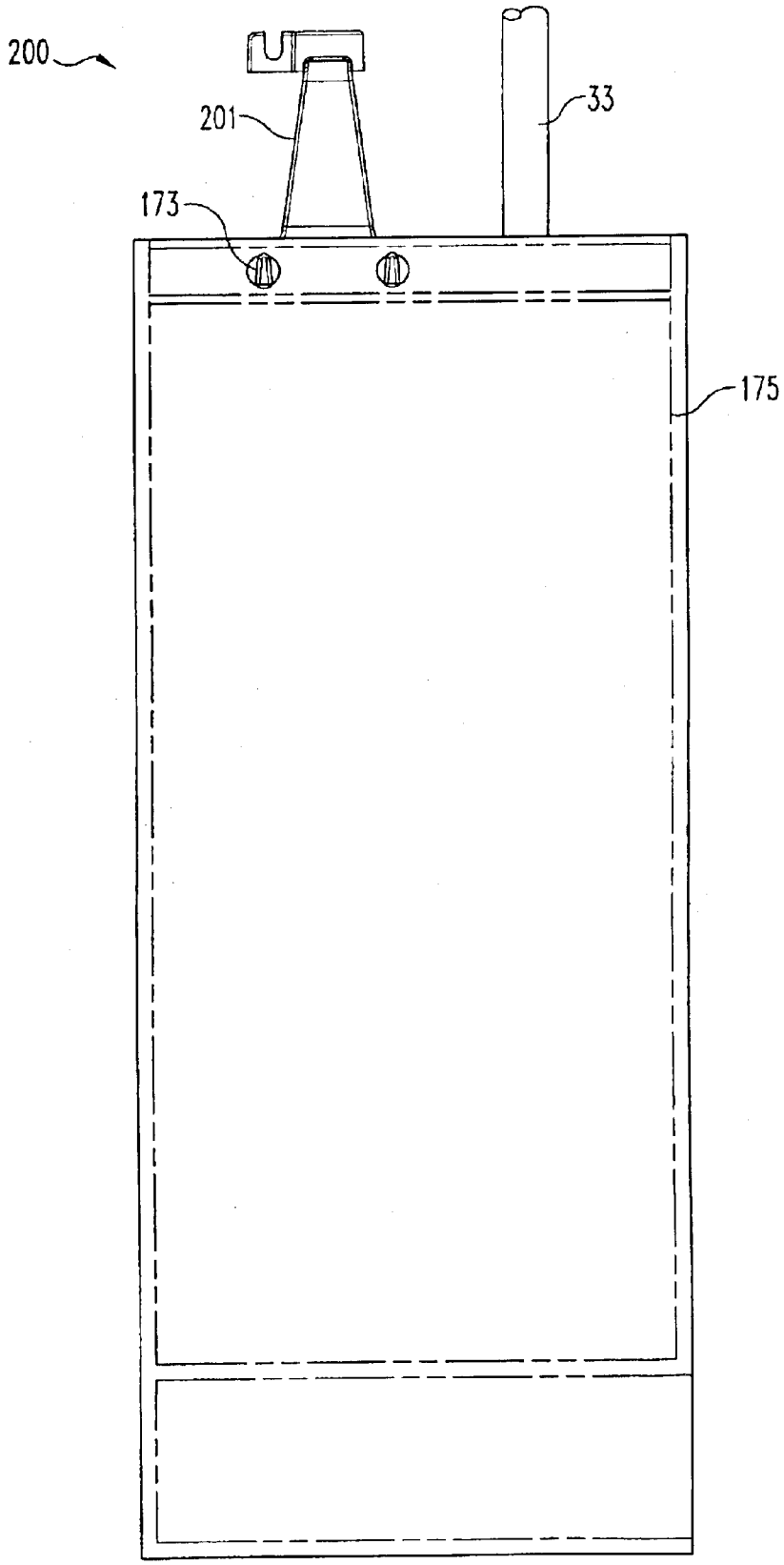
FIG. 17 is a side elevational view of a spray hose storage system that incorporates the FIG. 15 storage bag.
Figure 18:
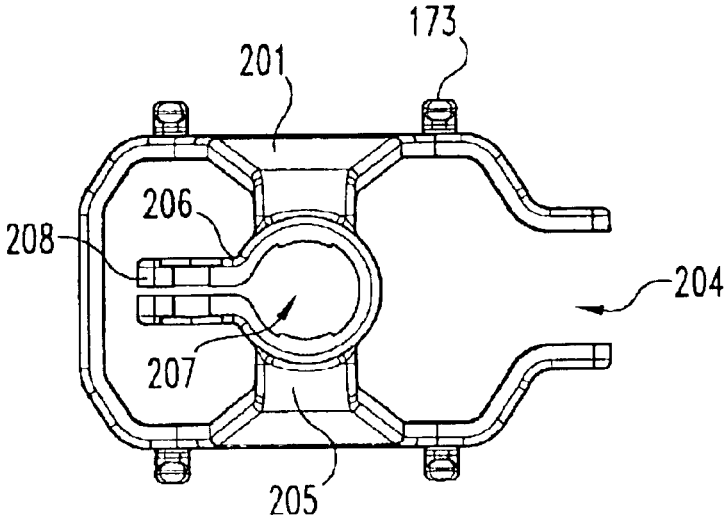
FIG. 18 is a top plan view of a mounting bracket used in the FIG. 17 system.
Figure 19:
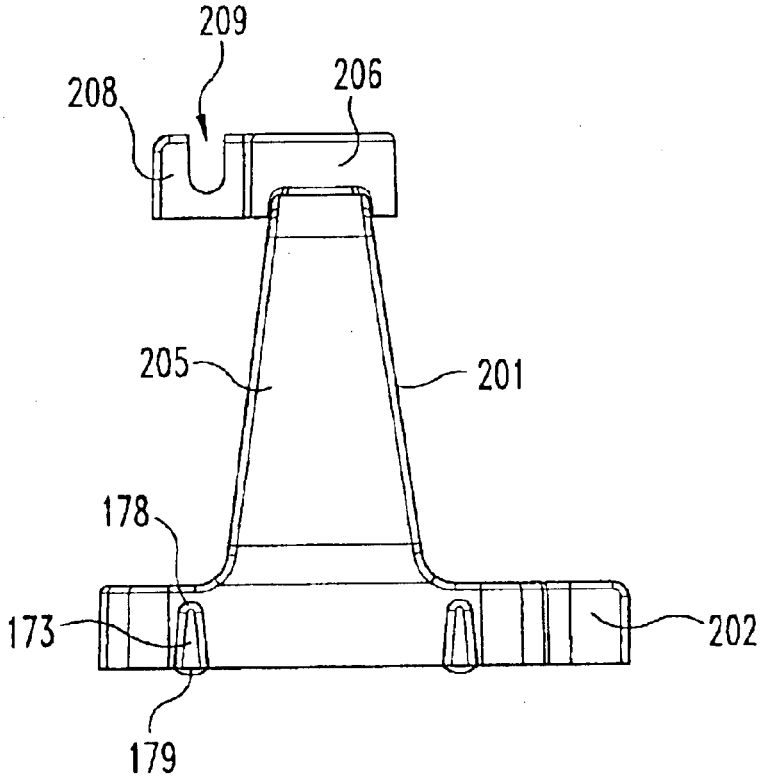
FIG. 19 is a side elevational view of the FIG. 18 mounting bracket.

FIGS. 17–19 illustrate a hose storage system 200 according to another embodiment of the present invention. The illustrated hose storage system 200 is configured for counterweight type hose retraction systems in which a counterweight is attached to the hose 33 in order to retract the hose 33. It is, however, contemplated that system 200 can be used with other types of retraction systems. As depicted in FIG. 17, system 200 includes a bag mounting bracket 201 on which hose storage bag 115 is hung. The mounting bracket 201 in FIGS. 18–19 has a bag engagement portion 202 with hooks 173 on which the bag 115 is hung. Like the embodiment described above, the hooks 173 have opposing first 178 and second 179 hook members. In the illustrated embodiment, the bag engagement portion 202 is structured to keep the hose storage pocket 184 open so that pocket 184 can receive the hose 33. Portion 202 is U-shaped and defines a hose slot 204 through which the hose 33 can pass. In the mounting bracket 201, a pair of attachment arms 205 attach the bag engagement portion 202 to a mounting shank clamping member 206 that is adapted to secure the bracket 201 to the mounting shank 52. The clamping member 206 has a shank opening 207 in which the mounting shank 52 is received and a pair of clamping flanges 208. Flanges 208 each have a nut slot 209 configured to receive bolt 162 and nut 163 that clamp the flanges 208 together to thereby clamp the mounting shank 52 in the clamping member 206. By clamping the bracket 201 to the mounting shank 52, installation of the system 200 is simplified because the position of the hose 33 is fixed relative to the position of the bag 115.

Once system 200 is installed, the hose storage bag 115 prevents the hose 33 as well as the counterweight from being entangled during extension and retraction of the hose 33.

Figure 20:
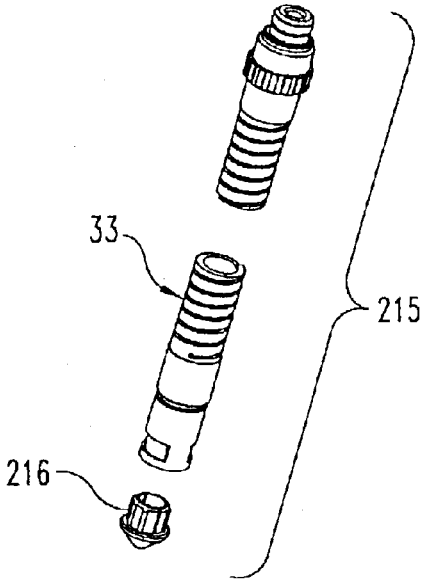
FIG. 20 is an exploded view of a hose lead assembly according to one embodiment of the present invention.
Figure 21:
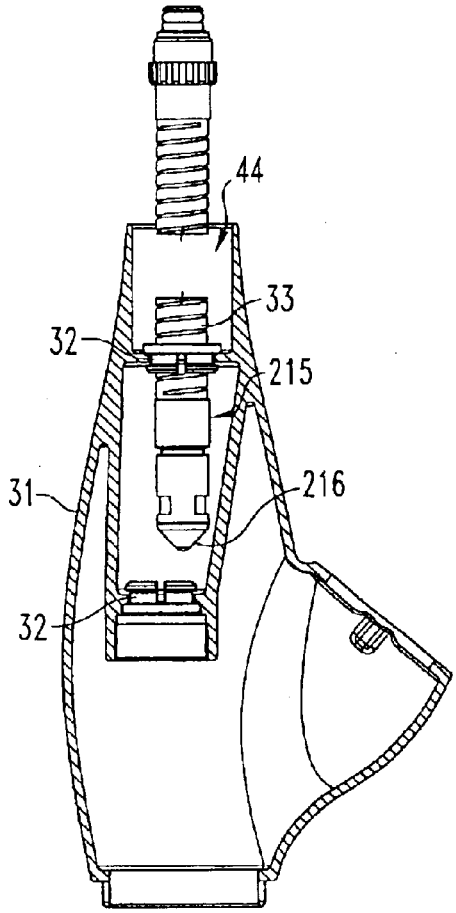
FIG. 21 is a side elevational cross-sectional view, in full section, of the FIG. 20 hose lead assembly inserted in the FIG. 1 hose guide hub assembly.

During installation of the above discussed faucet systems, the hose 33 is threaded through the faucet hub 31 so that one end of the hose 33 can be attached to the faucet from underneath the faucet. Since the hose guides 32 in the hub 31 are offset from one another, threading of the hose 33 through the guides 32 can be rather difficult. FIGS. 20–21 illustrate a hose lead assembly 215 according to one embodiment of the present invention that makes threading of the hose 33 through the hub 31 easier. In the illustrated hose lead assembly 215, a hose lead 216 is attached to one end of the hose 33 so as to guide the hose 33 through the faucet hub 31. In one embodiment, the hose lead 216 is made of plastic, but it is contemplated that the hose lead 216 can be made from other types of materials. For example, the hose lead 216 can be made of steel, which provides extra weight on the end of the hose 33 to aid threading.

Figure 22:
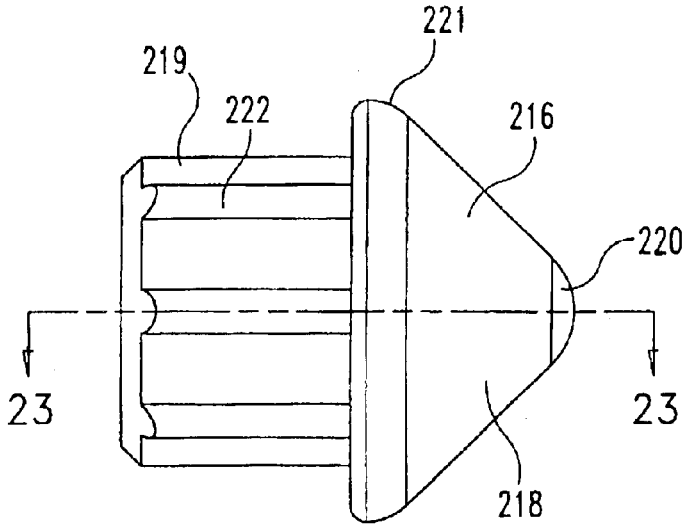
FIG. 22 is a side elevational view of a hose lead used in the FIG. 20 assembly.
Figure 23:
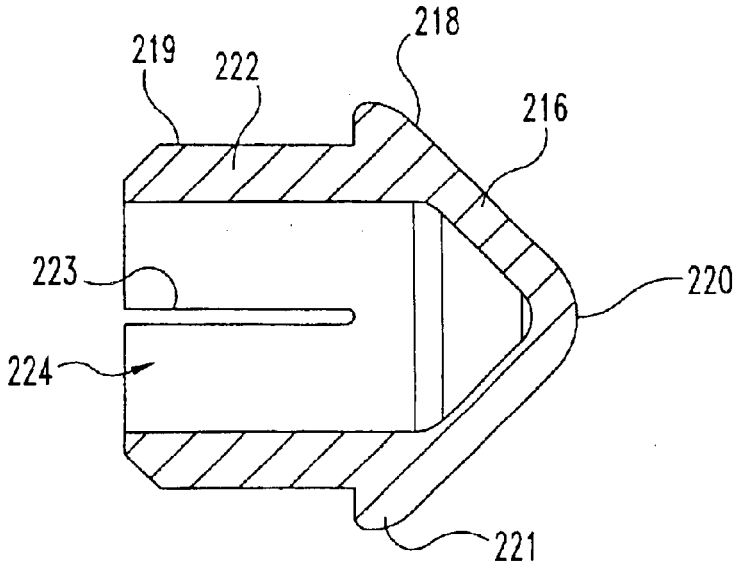
FIG. 23 is a front elevational cross-sectional view, in full section, of the FIG. 22 hose lead as taken along line 23—23 in FIG. 22.

Referring to FIGS. 22–23, the hose lead 216 is generally arrow-shaped and has a guide portion 218 that extends from a hose attachment portion 219. The hose attachment portion 219 is configured to frictionally engage inside the end of the hose 33. In the illustrated embodiment, the guide portion 218 is conically shaped and has a rounded nose portion 220 that aids in guiding the lead 216 through the hub 31. The guide portion 218 further has a flange portion 221 that extends around the hose attachment portion 219. As shown, the flange portion 221 is rounded to minimize the chance that the lead 216 will be snared inside the hub 31. Among its many functions, the flange portion 221 prevents the guide portion 218 of the lead 216 from slipping into the hose 33. In the illustrated embodiment, the flange portion 221 is sized to generally correspond to the outer dimensions of the hose 33. Extending along the entire length of the hose attachment portion 219, hose engagement ribs 222 are configured to frictionally engage the inside of the hose 33. As depicted in FIG. 23, the hose attachment portion 219 defines a pair of oppositely disposed deflection slots 223 that allow the attachment portion 219 to squeeze inside and engage the hose 33. To minimize the amount of material required to form the hose lead 216, the hose lead 216 according to one embodiment is hollow such that the hose lead 216 defines an internal cavity 224.

Before the hose 33 is threaded through the faucet hub 31, the installer attaches the hose lead 216 to the end of the hose 33 by inserting the hose attachment portion 219 into the hose 33. From the spout receptacle 44, the end of the hose 33 with the hose lead 216 is threaded through the hose guides 32 in the hub 31. Due to its generally conical shape, the guide portion 218 of the hose lead 216 is able to guide the hose 33 through the offset hose guides 32. After the hose 33 is guided through the hub 31, the hose lead 216 can be removed so that the hose 33 can be attached to the faucet. Afterwards, the hose lead 216 can be stored in the hose storage bag 175 for later use or can be discarded, if so desired.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A faucet system, comprising:

a faucet hub defining an internal cavity;

a first hose guide positioned inside said internal cavity, said first hose guide defining a first guide cavity that is centered around a first longitudinal axis;

a second hose guide positioned in said internal cavity, said second hose guide defining a second guide cavity that is centered around a second longitudinal axis that is out of alignment with said first longitudinal axis; and a hose slidably received in said first guide cavity of said first hole guide and said second guide cavity of said second hose guide to reduce wear on said hose.

2. The system of claim 1, wherein said faucet hub includes:

a first guide attachment flange that defines a first guide opening in which said first hole guide is secured, said first guide attachment flange being centered around said first longitudinal axis; and a second guide attachment flange that defines a second guide opening in which said second hose guide is secured, said second guide attachment flange being centered around said second longitudinal axis.

3. The system of claim 2, wherein said first guide includes one or more lock tabs that secure said first hose guide to said first guide attachment flange.

4. The system of claim 2, further comprising:

a hose guide tube in which said hose is slidably received; and wherein said hub defines a tube receptacle in which a portion of said hose guide tube is received.

5. The system of claim 4, wherein:

said first hose guide includes a stop flange and one or more lock tabs extending from said stop flange securing said first hose guide to said first guide attachment flange; and said hub defines a stop flange cavity in which said stop flange is received, said stop flange cavity being positioned between said first guide attachment flange and said tube receptacle.

6. The system of claim 1, further comprising a retraction mechanism coupled to said hose to retract said hose.

7. The system of claim 6, wherein said retraction mechanism includes a lock mechanism constructed and arranged to lock said hose in an extended position.

8. The system of claim 7, wherein said retraction mechanism includes:

a support structure;

a drive roller engaging said hose and rotatably mounted in said support structure; and a drive spring coupled between said support structure and said drive roller, said drive spring being constructed and arranged to wind during extension of said hose and unwind to retract said hose.

9. The system of claim 8, wherein said lock mechanism includes:

a ratchet gear secured to said drive roller;

a pawl pivotally coupled to said support structure;

a pawl spring coupled between said support structure and said pawl for biasing said pawl into engagement with said ratchet gear; and wherein said ratchet gear has an engagement portion with gear teeth to lock said hose in said extended position and a disengagement portion at which said pawl disengages from said gear teeth to retract said hose.

10. The system of claim 9, wherein said retraction mechanism includes:

a idler roller pivotally mounted on said support structure to engage said hose; and an idler spring coupled between said idler roller and said support structure to bias said idler roller against said hose.

11. The system of claim 6, wherein said retraction mechanism includes:

a support structure;

a drive roller engaging said hose and rotatably mounted in said support structure; and a drive spring coupled between said support structure and said drive roller, said drive spring being constructed and arranged to wind during extension of said hose and unwind to retract said hose.

12. The system of claim 6, further comprising a hose storage bag coupled to said hose retraction mechanism to store slack of said hose.

13. The system of claim 6, further comprising a spray head coupled to said hose.

14. The system of claim 1, further comprising:

a guide tube extending inside said hub, said hose being slidably received in said guide tube;

a bag mounting bracket coupled to said guide tube; and a hose storage bag hanging from said bag mounting bracket to store at least a portion of said hose.

15. The system of claim 14, wherein said hose storage bag has a first pocket in which said hose is stored and a second pocket for storing one or more faucet related items.

16. The system of claim 1, further comprising:

a spout coupled to said hub; and a spray head coupled to said hose to extend from said spout.

17. The system of claim 1, further comprising a hose lead coupled to one end of said hose for guiding said hose through said first hose guide and said second hose guide.

18. The system of claim 17, wherein said hose lead includes:

a hose attachment portion defining a pair of deflection slots and having a plurality of hose engagement ribs frictionally engaged inside said hose; and a guide portion extending from said hose attachment portion, said guide portion having a conical shape.

19. A faucet system, comprising:

a faucet hub;

a hose slidably received in said hub;

a faucet spray head coupled to said hose;

a retraction mechanism engaging said hose to retract said hose, said retraction mechanism including a lock mechanism constructed and arranged to prevent retraction of said hose at variable extended positions from said faucet hub and to allow retraction of said hose upon further extension of said hose; and wherein said faucet hub has a faucet spout to which said spray head engages when fully retracted.

20. The system of claim 19, wherein said retraction mechanism includes:

a support structure;

a drive roller engaging said hose and rotatably mounted in said support structure; and a drive spring coupled between said support structure and said drive roller, said drive spring being constructed and arranged to wind during extension of said hose and unwind to retract said hose.

21. The system of claim 20, wherein said lock mechanism includes:

a ratchet gear secured to said drive roller;

a pawl pivotally coupled to said support structure;

a pawl spring coupled between said support structure and said pawl for biasing said pawl into engagement with said ratchet gear; and wherein said ratchet gear has an engagement portion with gear teeth to lock said hose in one of said extended positions and a disengagement portion at which said pawl disengages from said gear teeth to allow retraction of said hose.

22. The system of claim 21, wherein said retraction mechanism includes:

a idler roller pivotally mounted on said support structure to engage said hose;

an idler spring coupled between said idler roller and said support structure to bias said idler roller against said hose to minimize slippage between said hose and said drive roller.

23. The system of claim 22, further comprising a hose storage bag hanging from said hose retraction mechanism to store slack of said hose.

24. The system of claim 23, wherein:

said hose storage bag has a first pocket with an opening for storing said hose and a second pocket with an opening for storing objects concerning the faucet system; and said opening in said second pocket opens transversely to said opening of said first pocket to allow easy access to said second pocket.

25. The system of claim 24, further comprising a hose guide received in said hub to guide said hose in said hub.

26. The system of claim 19, wherein said lock mechanism includes:

a ratchet gear;

a pawl engageable with said ratchet gear;

a pawl spring coupled to said pawl to bias said pawl into engagement with said ratchet gear; and wherein said ratchet gear has an engagement portion with gear teeth to lock said hose in one of said extended positions and a disengagement portion at which said pawl disengages from said gear teeth to allow retraction of said hose.

27. The system of claim 26, wherein said pawl includes a disengagement surface having a convex shape to ride along said gear teeth during retraction of said hose.

28. The system of claim 19, wherein said retraction mechanism includes:

a idler roller pivotally mounted on said support structure to engage said hose; and an idler spring to bias said idler roller against said hose to minimize slippage of said hose in said retraction mechanism.

29. A faucet system, comprising:

a faucet hub;

a hose slidably received in said hub;

a faucet spray head coupled to said hose;

a hose guide tube coupled to said faucet hub, said hose being slidably received in said guide tube;

a bag mounting bracket secured to said guide tube; and a hose storage bag hanging from said bag mounting bracket, said hose storage bag defining a hose pocket in which slack of said hose is stored.

30. The system of claim 29, wherein said bag mounting bracket includes a clamping member that clamps said bag mounting bracket to said guide tube.

31. The system of claim 29, wherein:

said hose pocket has an opening;

said bag includes a second pocket with an opening for storing at least one object concerning the faucet system; and said opening in said second pocket opens transversely to said opening of said hose pocket to allow easy access to said second pocket.

32. The system of claim 29, wherein:

said bag mounting bracket includes a retraction mechanism to retract said hose; and said hub includes a hose guide to guide said hose in said hub.

33. An apparatus, comprising:

a hose storage bag including a hose pocket with a hose opening for storing slack of a hose from a faucet;

said hose storage bag further including a storage pocket for storing at least one item related to the faucet; and said storage pocket having a storage opening that opens transverse to said hose opening to provide easy access to said storage pocket when said hose storage bag is installed.

34. The apparatus of claim 33, further comprising at least one hook opening disposed proximal said hose opening for hanging said hose storage bag.

35. The apparatus of claim 33, wherein said storage opening opens perpendicular to said hose opening.

36. The apparatus of claim 33, wherein said storage pocket is disposed below said hose pocket when said hose storage bag is installed.

37. The apparatus of claim 33, further comprising the item stored in said storage pocket.

38. The apparatus of claim 37, wherein the item includes an instruction manual for the faucet.

39. The apparatus of claim 37, wherein the item includes a tool for the faucet.

40. The apparatus of claim 33, further comprising:

the faucet;

the hose slidably received in the faucet;

a faucet spray head coupled to the hose;

a hose guide tube coupled to the faucet, the hose being slidably received in the guide tube; and means for securing said hose storage bag to said hose guide tube.

* * * * *